US006253941B1

(12) United States Patent
VanBrocklin et al.

(10) Patent No.: US 6,253,941 B1
(45) Date of Patent: Jul. 3, 2001

(54) ASSEMBLY FOR SECURING AND SEALING A DISPENSER TO A FLANGED CONTAINER

(75) Inventors: Owen F. VanBrocklin, Bristol; Sergei Fedorjaczenko, Canton, both of CT (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/487,433

(22) Filed: Jan. 19, 2000

Related U.S. Application Data

(60) Provisional application No. 60/116,394, filed on Jan. 19, 1999.

(51) Int. Cl.[7] ..... B65D 45/30; B65D 45/32; B65D 47/34

(52) U.S. Cl. ..... 215/274; 220/320; 222/153.1; 222/321.9; 222/385

(58) Field of Search ..... 215/274, 276, 215/319, 324, 272; 220/794, 309.1, 319, 320, 289; 222/153.1, 321.9, 385

(56) References Cited

U.S. PATENT DOCUMENTS

| | | | | |
|---|---|---|---|---|
| 1,609,453 | | 12/1926 | Atwood et al. . | |
| 2,117,407 | * | 5/1938 | Davis | 220/288 |
| 2,723,773 | | 11/1955 | Greene . | |
| 3,297,187 | * | 1/1967 | Thiesen | 215/272 |
| 3,973,688 | | 8/1976 | Kvam . | |
| 4,073,398 | | 2/1978 | Schultz . | |
| 4,109,820 | * | 8/1978 | Stifano | 220/289 |
| 4,251,003 | | 2/1981 | Bodenmann . | |
| 4,279,353 | | 7/1981 | Honma . | |
| 4,359,166 | | 11/1982 | Dubach . | |
| 4,773,553 | | 9/1988 | Van Brocklin . | |
| 5,096,094 | * | 3/1992 | Guilbert | 222/153 |
| 5,192,006 | | 3/1993 | Van Brocklin et al. . | |
| 5,348,174 | | 9/1994 | Velicka . | |
| 5,562,219 | | 10/1996 | de Pous et al. . | |
| 5,692,650 | * | 12/1997 | Wolter et al. | 222/321.9 |
| 5,799,810 | | 9/1998 | de Pous et al. . | |
| 5,941,428 | * | 8/1999 | Behar et al. | 222/321.9 |

FOREIGN PATENT DOCUMENTS

| | | |
|---|---|---|
| 27 08 530 | 2/1977 | (DE) . |
| 2534557 | 4/1984 | (FR) . |
| 549372 | 2/1956 | (IT) . |

* cited by examiner

*Primary Examiner*—Allan N. Shoap
*Assistant Examiner*—Niki M. Eloshway
(74) *Attorney, Agent, or Firm*—St. Onge Steward Johnston & Reens LLC

(57) ABSTRACT

An assembly for securing and sealing a dispenser to a flanged container is provided. The assembly includes a sealing collet formed from a resilient deformable molded polymeric material. The sealing collet has an outer surface having an outer diameter, and also has a continuous downwardly extending skirt having a bottom portion thereof extending radially outwardly. The assembly also includes a retaining collar formed from a substantially rigid material, which has a sleeve about its periphery having an inner surface with a diameter sized to encase the skirt of the sealing collet. The retaining collar is slideable through a path of movement over the sealing collet to an assembled position. The sleeve deforms the bottom portion of the skirt radially inwardly to a position under the flange as the retaining collar is slid to the assembled position in order to maintain the sealing collet and the retaining collar in the assembled position and to maintain the seal between the sealing collet and the flange. A plurality of annular splines, grooves or a combination thereof are provided on inner surface of the sleeve, and are positioned to engage the outer surface of the sealing collet when the retaining collar is in the assembled position. The splines or grooves are formed to such an extent that they cause the outer surface of the sealing collet to deform therearound when the retaining collar is in the assembled position to enhance the maintenance of the retaining collar on the sealing collet in the assembled position.

31 Claims, 6 Drawing Sheets

ASSEMBLY FOR SECURING AND SEALING A DISPENSER TO A FLANGED CONTAINER

RELATED APPLICATIONS

This application claims the benefit of U.S. Provisional Application No. 60/116,394, filed Jan. 19, 1999.

FIELD OF THE INVENTION

The present invention relates to an assembly for securing and sealing a dispenser, such as a pump, a valve, or other dispensing means to a flanged container. More particularly, the present invention relates to an improved assembly for securing a dispenser to a container without the necessity of complex mechanical operations.

BACKGROUND OF THE INVENTION

It is often desirable to secure a dispenser, such as a pump, a valve, or other dispensing means to a container for storing a liquid product. A typical container may be made of glass and have a neck with an opening for dispensing the product. A flange having an inwardly directed ledge is often provided to facilitate attachment of a cap or dispensing device to the container.

Various methods are known for securing a dispenser onto a flanged container. One such method is to provide the dispenser with a metal mounting ferrule. To attach the dispenser to the container, the bottom of the skirt of the mounting furrule is deformed, or crimped, beneath the container flange to retain the dispenser in place. Such a crimping operation, however, requires specialized machinery made specifically for the crimping operation. Moreover, since each dispenser must be positioned accurately, and then crimped, the process of crimping the mounting furrules is relatively time consuming. Furthermore, set-up of the crimping process requires precise adjustment of the crimping head in order to fully crimp the mounting furrule onto the container. If the flange of the container varies even slightly from the dimensions defined during set-up, the crimping process may easily fail. If the flange is too small, a tight crimp may not occur, which can result in leakage. If the flange is too large or if the height of the bottle varies from what is expected, the forces necessary for crimping may crush the flange, thereby causing the container to break. Such breaking of the container requires the assembly line to be stopped so the broken container can be removed and the assembly line machinery cleaned, and results in loss of the package, including the fragrance, which is often particularly costly.

Another method for securing a dispenser onto a flanged container utilizes a hard plastic collar having an annular recess which receives the flange. An annular retaining rib snap-locks under the flange when installed. Such designs, however, typically require the use of hard plastics, which are not effective for providing a liquid seal and therefore require a gasket. As such, leakage problems often result. Moreover, as is the case with crimping, variances in flange dimensions can easily cause failure. If the flange is too small, the retaining rib snap locks may not pull the collar into sealing engagement with the container, which can result in leakage. If the flange is too large, the retaining rib snap-locks may not fit properly underneath the flange, which too can result in leakage and retention failure of the dispenser.

The disadvantages of the above discussed methods and assemblies are substantially obviated by the assembly and method disclosed in U.S. Pat. No. 4,773,553 to Van Brocklin, which is incorporated herein by reference. The assembly disclosed therein comprises a mounting cup having a generally cylindrical skirt around its periphery and a sealing collar. The sealing collar includes a sleeve having a diameter sized to receive the sidewall of the flange, and sized to be encased by the mounting cup. The end portion of the sleeve, which comprises a plurality of spaced tabs, is in the path of movement of the mounting cup and is deformed radially inwardly beneath the flange ledge thereby to secure the collar to the flange.

The present invention is an improvement upon the method and assembly described in the aforesaid U.S. Pat. No. 4,773,553 as well as any other sealing method and assembly employing a plastic collar and a mounting cup slideable over the plastic collar, or equivalents thereof.

What is desired, therefore, is an assembly which secures and seals a dispenser, such as a pump or valve, to a flanged container, which is less expensive than known assemblies to manufacture, which requires a reduced force to attach the assembly to the container, which provides an increased retention force of the components, which is aesthetically pleasing, and which can employ a standard collar used with known crimped assemblies.

SUMMARY OF THE INVENTION

Accordingly, it is an object of the present invention to provide an assembly which secures and seals a dispenser, such as a pump or valve, to a flanged container.

Another object of the present invention is to provide an assembly having the above characteristics and which is less expensive than known assemblies to manufacture.

A further object of the present invention is to provide an assembly having the above characteristics and which requires a reduced force to attach the assembly to the container.

Still another object of the present invention is to provide an assembly having the above characteristics and which provides an increased retention force of the components.

Yet a further object of the present invention is to provide an assembly having the above characteristics and which is aesthetically pleasing.

Still a further object of the present invention is to provide an assembly having the above characteristics and which can employ a standard collar used with known crimped assemblies.

These and other objects of the present invention are achieved by provision of an assembly for securing and sealing a dispenser to a flanged container. The assembly includes a sealing collet formed from a resilient deformable molded polymeric material. The sealing collet has an outer surface having an outer diameter, and also has a continuous downwardly extending skirt having a bottom portion thereof extending radially outwardly. The assembly also includes a retaining collar formed from a substantially rigid material, which has a sleeve about its periphery having an inner surface with a diameter sized to encase the skirt of the sealing collet. The retaining collar is slideable through a path of movement over the sealing collet to an assembled position. The sleeve of the retaining collar deforms the bottom portion of the skirt of the sealing collet radially inwardly to a position under the flange of the container as the retaining collar is slid to the assembled position in order to maintain the sealing collet and the retaining collar in the assembled position and to maintain the seal between the sealing collet and the flange. A plurality of annular retaining rings, which preferably comprise splines, grooves or a combination thereof, are provided on inner surface of the sleeve of the retaining collar, and are positioned to engage the outer surface of the sealing collet when the retaining collar is in the assembled position. The retaining rings are formed to such an extent that they cause the outer surface of the sealing collet to deform therearound when the retaining collar is in the assembled position to enhance the maintenance of the retaining collar on the sealing collet in the assembled position.

In one embodiment, each of the splines has a frustoconical portion having an upper end having a diameter less than the diameter of the inner surface of the sleeve of the retaining collar and having a lower end having a diameter greater than the upper end. Preferably, the lower end of the frustoconical portion of each of the splines has a diameter substantially equal to the diameter of the inner surface of the sleeve of the retaining collar. In other embodiments, the splines are barbed or partially rounded.

In another embodiment, each of the grooves has a frustoconical portion having a lower end having a diameter greater than the diameter of the inner surface of the sleeve of the retaining collar and having an upper end having a diameter less than the lower end. Preferably, the upper end of the frustoconical portion of each of the grooves has a diameter substantially equal to the diameter of the inner surface of the sleeve of the retaining collar. In other embodiments, the grooves partially rounded, and the sleeve of the retaining collar includes a combination of splines and grooves.

The invention and its particular features and advantages will become more apparent from the following detailed description considered with reference to the accompanying drawings.

DETAILED DESCRIPTION OF THE INVENTION

Figure 1:
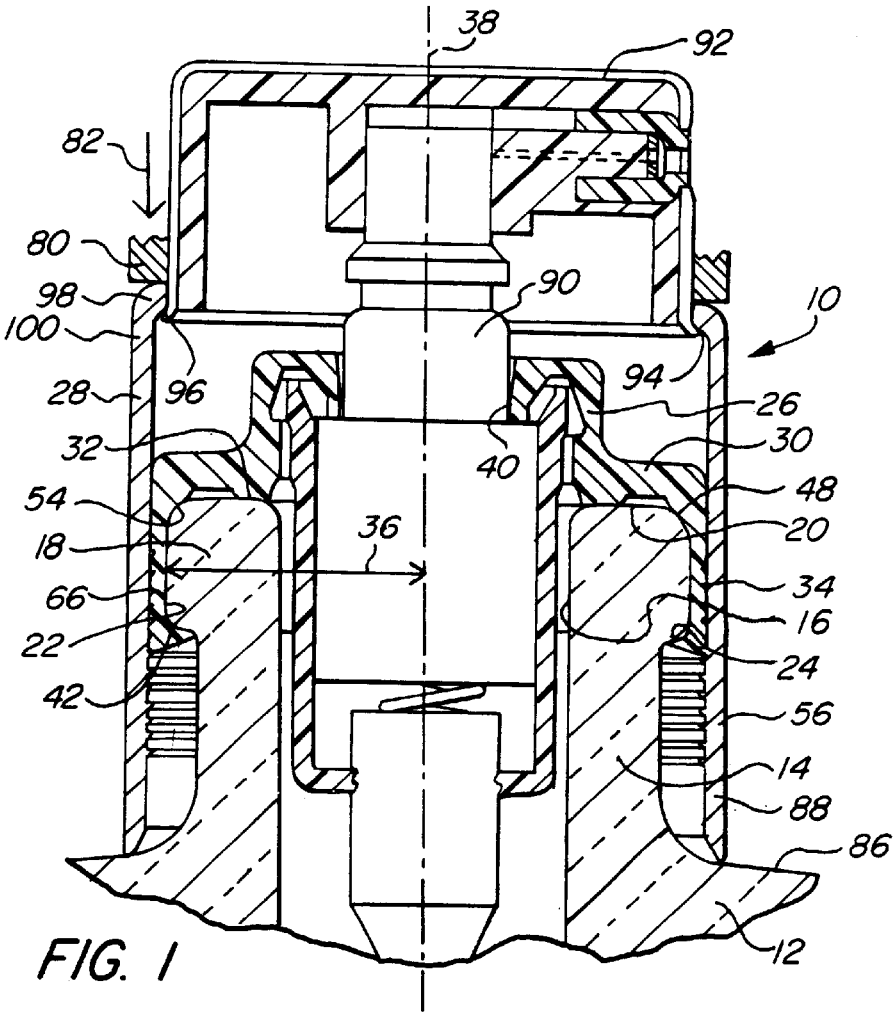
FIG. 1 is a partially cross-sectional view of an assembly for securing and sealing a dispenser to a flanged container in accordance with the present invention.
Figure 3:
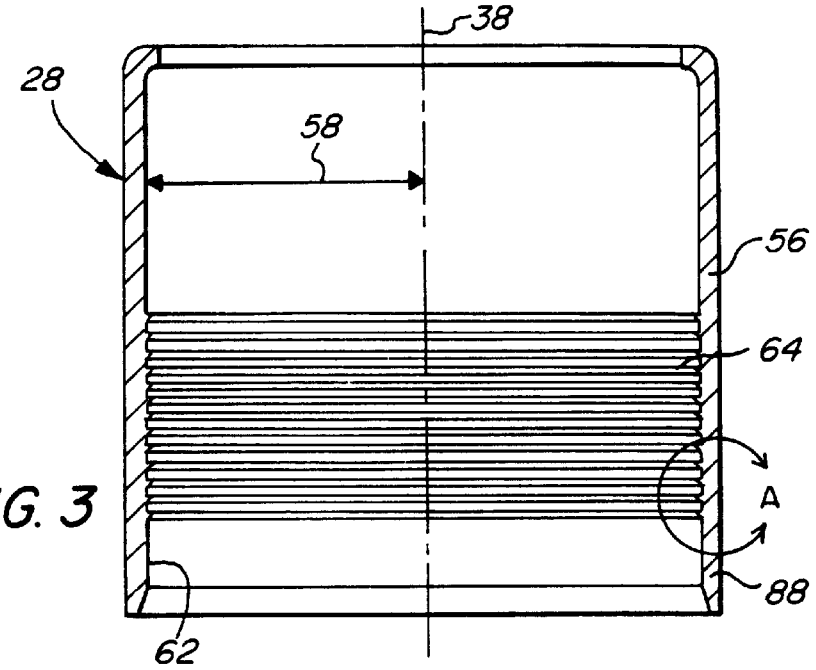
FIG. 3 is a partially cross-sectional view of a retaining collar of the assembly for securing and sealing a dispenser to a flanged container of FIG. 1.

Referring first to FIG. 1, an assembly 10 in accordance with the present invention is shown. The assembly 10 is particularly suited for use with a container 12 of the type having a neck 14 with an opening 16 for dispensing product stored in the container 12. The neck 14 includes a flange 18 which includes an upper surface 20 surrounding the opening 16, a sidewall 22 about its periphery and an inwardly directed ledge 24 at the bottom of the flange 18. The container 12 is typically made of glass, although other types of materials such as plastic or metal can be utilized. Assembly 10 in accordance with the present invention is particularly suited for use with cosmetic containers such as those containing perfume.

Assembly 10 includes a sealing collet 26 and a retaining collar 28. The sealing collet 26 comprises a deformable material, and preferably a resilient deformable material such as polyethylene, including linear low density polyethylene, rubber elastomers or vinyl. The sealing collet 26 includes a ring 30 having a floor 32 for contacting the upper surface 20 of the container flange 18. The sealing collet 26 also includes a skirt 34 extending from the ring 30. The skirt 34 has an inner diameter 36 sized to receive the sidewall 22 of the flange 18, and preferably, the inner diameter 36 of the skirt 34 is slightly larger than the diameter of the flange sidewall 22 to provide free-fitting application of the assembly 10 onto the flange 18 to facilitate assembly. The skirt 34 is preferably generally cylindrical and symmetric with respect to axis 38. In addition, an annular gasket (not shown) may be provided between the floor 32 and the upper surface 20 of the container flange 18. Such a gasket may be desirable to enhance the seal between the sealing collet 26 and the flange 18.

The sealing collet 26 can be designed to receive any number of different types of dispensers including pumps, valves, shaker plug type valve, squeeze type valves, and pouring type valves. The sealing collet 26 includes a central opening 40 for receiving the dispenser, such as a pump, and includes other structures which are designed specifically for the type of dispenser to be used with the assembly 10. Thus, the portion of the sealing collet 26 above the ring 30 is not described in detail inasmuch as it can be changed and adapted to various types of dispensers.

Figure 2:
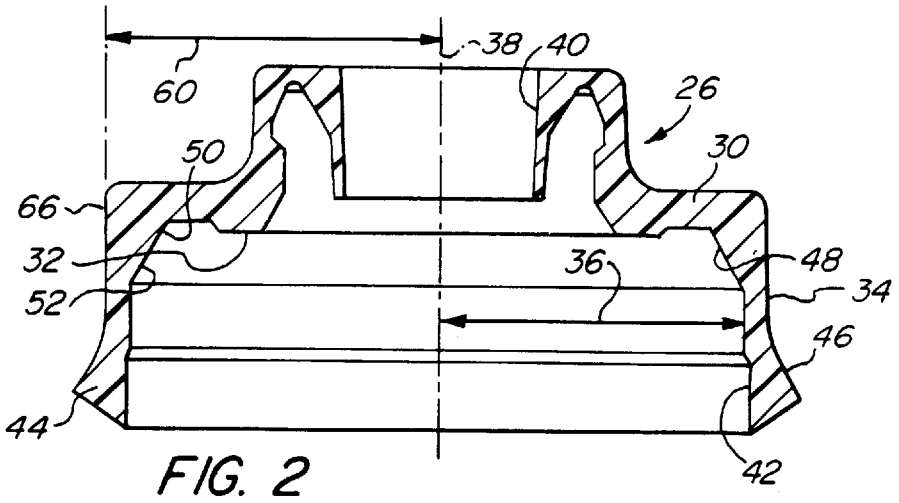
FIG. 2 is a partially cross-sectional view of a sealing collet of the assembly for securing and sealing a dispenser to a flanged container of FIG. 1.

Referring in particular to FIG. 2, the bottom portion 42 of skirt 34 includes a radially outwardly protruding member 44 located in the path of movement of the retaining collar 28. More specifically, the skirt 34 includes an inclined camming surface 46. When the retaining collar 28 moves downwardly it contacts camming surface 46 and forces the protruding member 44 radially inwardly. Unlike the assembly disclosed in the aforesaid U.S. Pat. No. 4,773,553, and other prior art assemblies, skirt 34 is continuous. More specifically, skirt 34 does not include a plurality of slots, cuts, indentations or slits defining a plurality or discrete tabs, fingers, legs, claws, or the like, with or without webs. It has been found that by providing a continuous skirt 34, the thickness of the skirt 34 can be reduced, thereby decreasing the amount of material required for manufacturing the sealing collet 26 and thus the overall cost of the system 10 in general. The decreased thickness of the skirt 34 also allows for the use of standard retaining collars typically used with crimped assemblies. Thus, custom made retaining collars are not required, which also reduces manufacturing costs.

Moreover, by providing a continuous skirt 34 having a reduced thickness, the camming surface 46 can be provided with a lesser angle than was previously required, thereby allowing the retaining collar 28 to slide more easily over the sealing collet 26 without the sharp edges of the retaining collar 28 digging into the sealing collet 26, and also thereby requiring less force to slide retaining collar 28 completely over sealing collet 26. More specifically, U.S. Pat. No. 4,773,553 disclosed that a camming surface of the assembly disclosed therein has an angle with respect to a vertical axis of between 30 and 60 degrees, most preferably 45 degrees. However, camming surface 46 of skirt 34 preferably has an angle with respect to vertical axis 38 of less than 45 degrees and most preferably of less than 30 degrees. It is also preferable that the sealing collet 26 be of a molded polymeric material which can be formed in a single piece. Alternatively, if necessary, the sealing collet 26 could be formed in a plurality of pieces so long as the bottom portion 42 is deformable.

Also as shown in FIG. 2, the skirt 34 also includes a frustoconical portion 48. The upper region 50 of frustoconical portion 48 has a diameter less than the diameter of the flange 18 while the lower region 52 has a diameter equal to or greater than the flange 18 diameter. As shown in FIG. 1, when assembled, the frustoconical portion 48 deforms slightly and contacts the flange 18 to provide an annular area 54 of contact, and thereby providing a seal.

Referring now to FIGS. 1 and 3–9, the retaining collar 28 will now be described in detail. The retaining collar 28 is made of a material which is substantially rigid, such as metal, hard plastic, wood or glass, and includes a sleeve 56 which has a shape symmetric with respect to common axis 38. More specifically, the retaining collar 28 has a generally cylindrical shape, but may also have a frustoconical shape symmetric with respect to central axis 38. The inner diameter 58 of the sleeve 56 is approximately equal to the outer diameter 60 of skirt 34. If desired, the inner diameter 58 of the sleeve 56 can be slightly less than the outer diameter 60 of skirt 34 so that the skirt 34 is slightly compressed between the flange sidewall 22 and the inner surface 62 of the retaining collar 28. Inner surface 62 includes a plurality of retaining rings 64, as described fully below.

Figure 4:
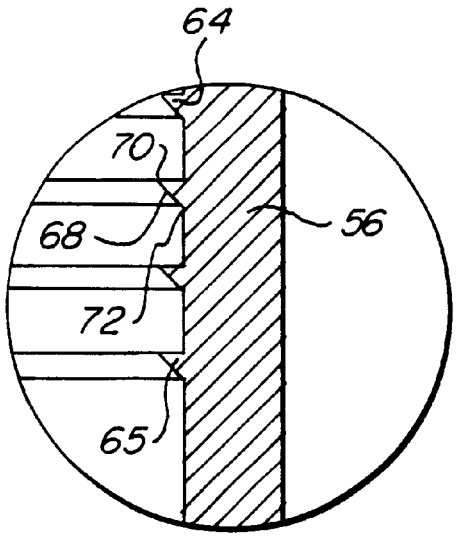
FIG. 4 is an enlarged partially cross-sectional view of portion A of the retaining collar of FIG. 3 showing a retaining collar having a plurality of frustoconical splines in accordance with one embodiment of the invention.
Figure 5:
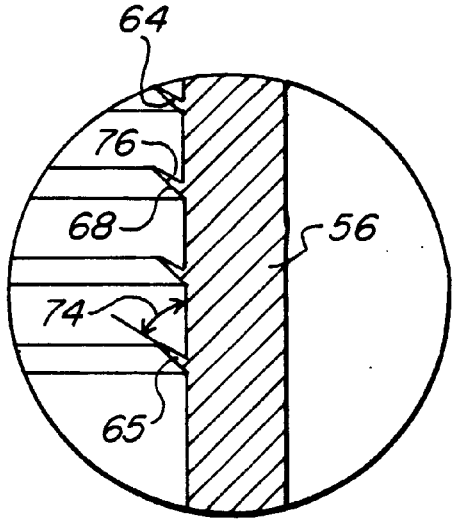
FIG. 5 is an enlarged partially cross-sectional view of portion A of the retaining collar of FIG. 3 showing a retaining collar having a plurality of barbed splines in accordance with a second embodiment of the invention.
Figure 6:
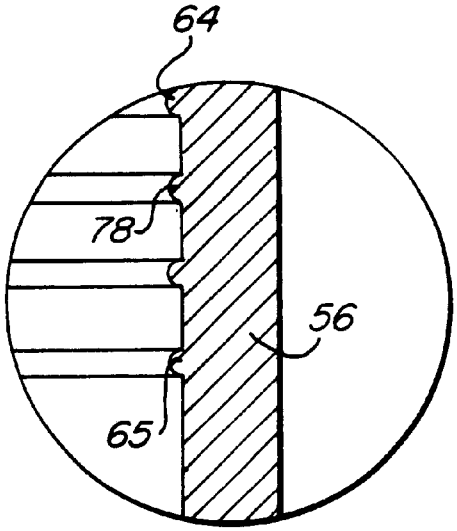
FIG. 6 is an enlarged partially cross-sectional view of portion A of the retaining collar of FIG. 3 showing a retaining collar having a plurality of partially rounded splines in accordance with a third embodiment of the invention.

Referring specifically now to FIGS. 4–6, retaining rings 64 may comprise a plurality of annular splines 65 protruding inwardly from inner surface 62 of sleeve 56. Splines 65 are located such that they are coincident with and engage an outer surface 66 of skirt 34 when the retaining collar 28 is in the assembled position. Splines 65 protrude to such an extent that splines 65 cause the outer surface 66 of the skirt 34 to deform around splines 65 when the retaining collar 28 is in the assembled position to enhance the maintenance of the retaining collar 28 in the assembled position on the sealing collet 26. Preferably, splines 65 are formed by rolling them on the inner surface 62 of the sleeve 56. By using this process to create splines 65, splines 65 can be formed without causing any aesthetically displeasing deformations on the smooth outer surface of the retaining collar 28, and standard retaining collars typically used with crimped assemblies can be modified rather than requiring the manufacture of more expensive custom made retaining collars.

In the embodiment shown in FIG. 4, each of splines 65 has a frustoconical portion 68 having an upper end 70 with a diameter less than the diameter 60 of the inner surface 62 of the sleeve 56 and having a lower end 72 with a diameter greater than the upper end 70. Preferably, the lower end 72 of the frustoconical portion 68 of each of splines 65 has a diameter substantially equal to the diameter 60 of the inner surface 62 of sleeve 56. FIG. 5 shows a sleeve 56 having splines 65 similar to those shown in FIG. 4, wherein each of splines 65 has a frustoconical portion 68. However, in this embodiment, each of splines 65 also includes a backdrafted angle 74 in the upper surface 76 of each spline 65 to form a barb. FIG. 6 shows another embodiment of the present invention wherein sleeve 56 includes a plurality of splines 65 having a partially rounded portion 78. It should be understood that although the embodiment shown in FIG. 6 may be used, the embodiments shown in FIGS. 4 and 5 are preferred. The frustoconical configuration of these embodiments allow for assembly with a lesser force, but once assembled, require a greater force for disassembly because the upper ends 70 of splines 65 dig into the outer surface 66 of skirt 34.

Figure 7:
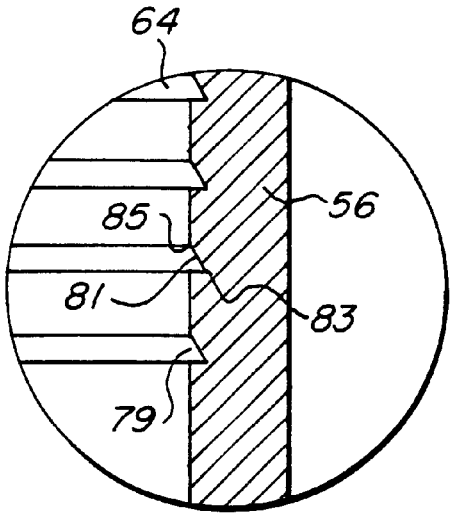
FIG. 7 is an enlarged partially cross-sectional view of portion A of the retaining collar of FIG. 3 showing a retaining collar having a plurality of frustoconical grooves in accordance with a fourth embodiment of the invention.
Figure 8:
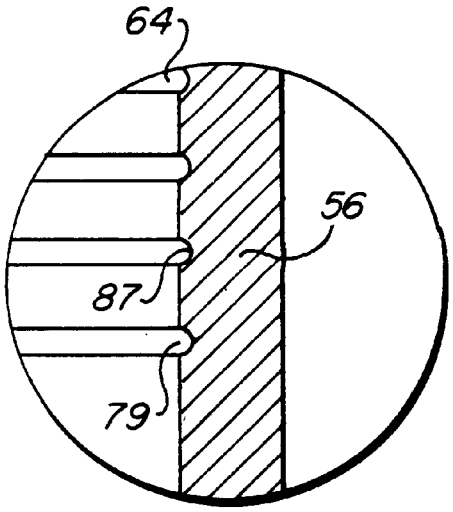
FIG. 8 is an enlarged partially cross-sectional view of portion A of the retaining collar of FIG. 3 showing a retaining collar having a plurality of partially rounded grooves in accordance with a fifth embodiment of the invention.

Referring specifically now to FIGS. 7 and 8, retaining rings 64 may comprise a plurality of annular grooves 79 recessed into inner surface 62 of sleeve 56. Grooves 79 are located such that they are coincident with and engage an outer surface 66 of skirt 34 when the retaining collar 28 is in the assembled position. Grooves 79 are formed to such an extent that grooves 79 cause the outer surface 66 of the skirt 34 to deform to substantially fill grooves 79 when the retaining collar 28 is in the assembled position to enhance the maintenance of the retaining collar 28 in the assembled position on the sealing collet 26. Preferably, grooves 79 are formed by rolling them on the inner surface 62 of the sleeve 56. By using this process to create grooves 79, grooves 79 can be formed without causing any aesthetically displeasing deformations on the smooth outer surface of the retaining collar 28, and standard retaining collars typically used with crimped assemblies can be modified rather than requiring the manufacture of more expensive custom made retaining collars.

In the embodiment shown in FIG. 7, each of grooves 79 has a frustoconical portion 81 having a lower end 83 with a diameter larger than the diameter 60 of the inner surface 62 of the sleeve 56 and having an upper end 85 with a diameter less than the lower end 83. Preferably, the upper end 85 of the frustoconical portion 81 of each of grooves 79 has a diameter substantially equal to the diameter 60 of the inner surface 62 of sleeve 56. FIG. 8 shows another embodiment of the present invention wherein sleeve 56 includes a plurality of grooves 79 having a partially rounded portion 87. It should be understood that although the embodiment shown in FIG. 7 may be used, the embodiment shown in FIG. 7 is preferred. The frustoconical configuration of this embodiment allows for assembly with a lesser force, but once assembled, require a greater force for disassembly because the upper ends 83 of grooves 79 dig into the outer surface 66 of skirt 34.

Figure 9:
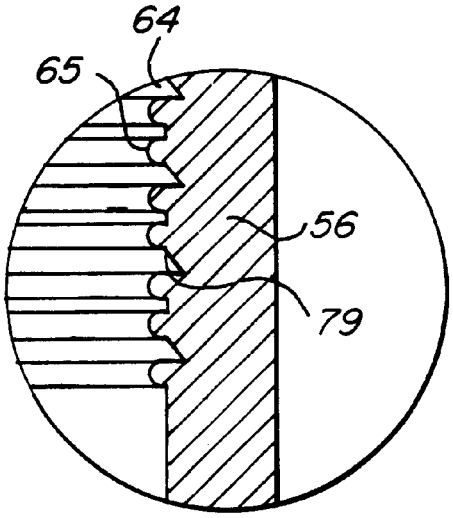
FIG. 9 is an enlarged partially cross-sectional view of portion A of the retaining collar of FIG. 3 showing a retaining collar having a combination of a plurality of frustoconical grooves and a plurality of partially rounded splines in accordance with a sixth embodiment of the invention.

Referring specifically now to FIG. 9, retaining rings 64 may comprise a combination of a plurality of annular splines 65 protruding from inner surface 62 of sleeve 56 and a plurality of annular grooves 79 recessed into inner surface 62 of sleeve 56. Preferably, grooves 79 and splines 65 are formed in one action by rolling them on the inner surface 62 of the sleeve 56. More specifically, as grooves 79 are rolled, material is displaced to at the same time create splines 65. FIG. 9 shows frustoconical grooves 79 and partially rounded splines 65. However, it should be understood that various combinations of groove and spline configurations may be used.

Figure 10:
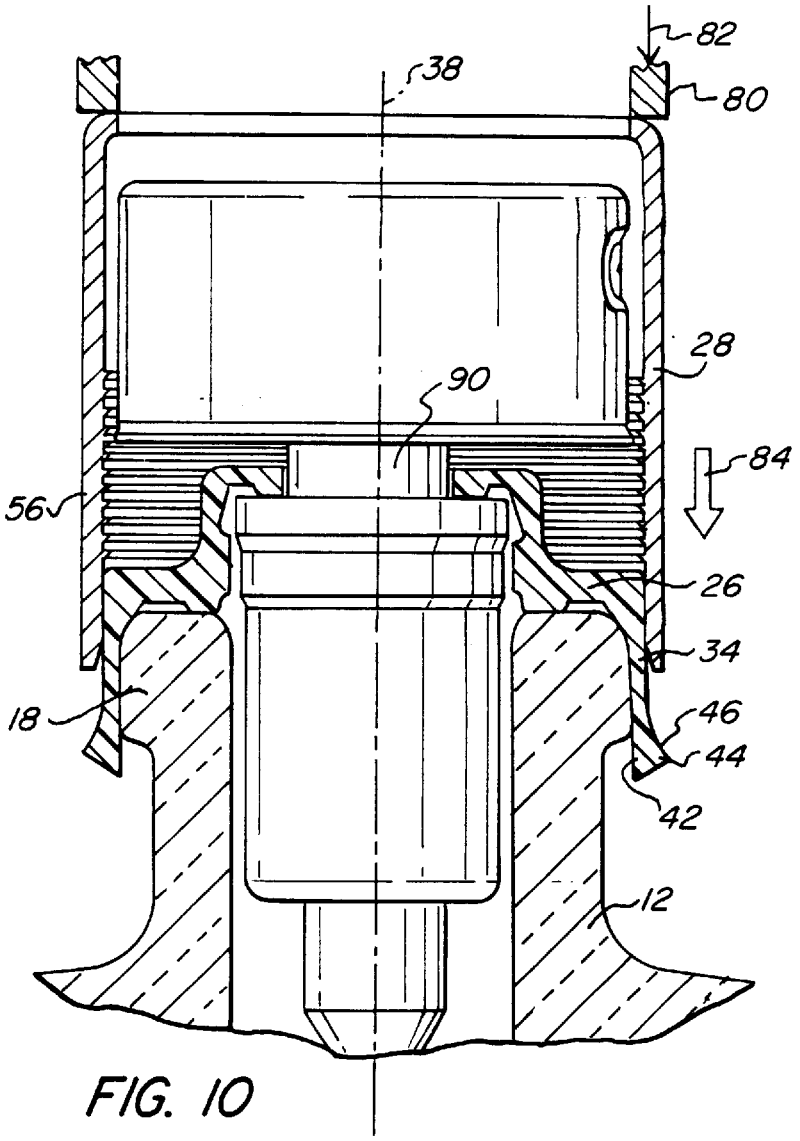
FIGS. 10–12 are partially cross-sectional views of the assembly for securing and sealing a dispenser to a flanged container of FIG. 1 shown at various stages of assembly.
Figure 11:
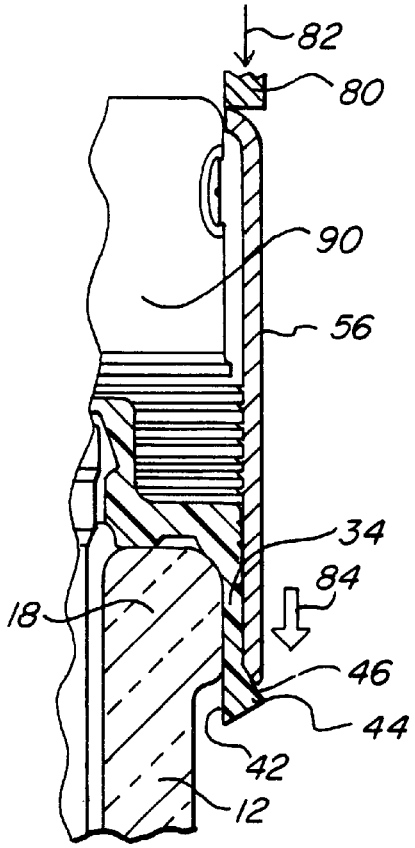

Referring now to FIGS. 1 and 10–12, the apparatus for assembling assembly 10 includes an annular ring or cup 80 that is movable downwardly in the direction of arrow 82 to the position shown in FIG. 1, which is the assembled position. The annular ring or cup 80 is shown schematically and is connected to suitable mechanical devices for moving the ring or cup 80 downwardly. The container 12 is maintained in a stationary position, and the components slide only along the axis 38 which is an axis common to the retaining collar 28, the sealing collet 26 and the container flange 18. The sealing collet 26 may be placed on the flange 18 in the position shown in FIG. 10. Alternatively, if desired, the sealing collet 26 could be placed at a position wherein there is a space between the floor 32 and the upper surface 20 of the flange 18, and, as described above, a gasket may be provided between the floor 32 and the upper surface 20 of the flange 18. The retaining collar 28 is placed over the sealing collet 26 and forced axially downwardly in the direction of arrow 84 with respect to the container 12. The ring or cup 80 contacts the retaining collar 28 and urges the retaining collar 28 downwardly (FIG. 10). The sleeve 56 of the retaining collar 28 contacts the radially protruding member 44 of the bottom portion 42 of the skirt 34, or more precisely, camming surface 46, and exerts a downward force on the entire sealing collet 26 (FIG. 11). In the instance where the floor 32 is spaced from the flange 18 in an initial condition, the force of the sleeve 56 against the protruding member 44 urges the entire sealing collet 26 axially downwardly. In the instance where a gasket is disposed between the floor 32 and the upper surface 20 of the flange 18, the force of the sleeve 56 against the protruding member 44 crushes the gasket.

Figure 12:
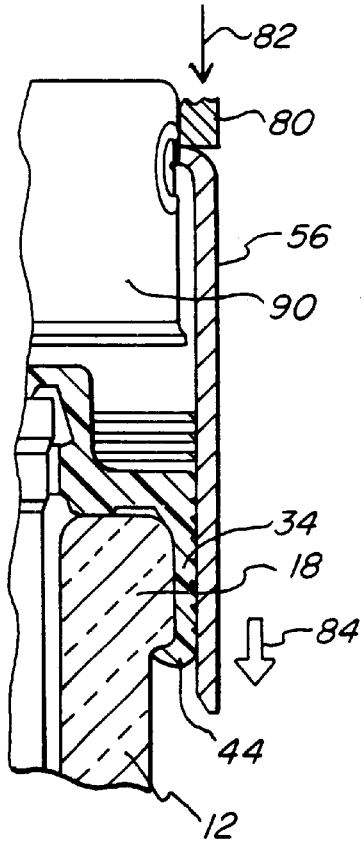

As the retaining collar 28 is forced further downwardly by the ring or cup 80, the sleeve 56 urges the protruding member 44 and the camming surface 46 thereof radially inwardly and thus deforms the bottom portion 42 to a position under the ledge 24 of the flange 18, as shown in FIG. 12. Retaining collar 28 may then be forced further downwardly to the fully assembled position shown in FIG. 1. It should be understood that by a "ledge" it is meant an inward slot or groove which is capable of receiving bottom portion 42. In certain instances, it may be desirable to include a flange 18 having a continuous sidewall which extends to the shoulder 86 of the container 12. In such instance, the ledge 24 would be simply an annular groove sized to receive the deformed bottom portion 42.

The method of assembly has been described with the annular ring or cup 80 moving with respect to a stationary container 12. It should be understood that it is the relative movement which produces the assembly of the various components, and it is also possible to move the container 12 and the various components upwardly with respect to an annular ring or cup 80.

As can be appreciated, the method of assembly is particularly simple and does not require complicated machinery. The only required step is the reciprocating of an annular ring or cup 80 which contacts the retaining collar 28. If necessary, the components could be assembled by a hand press. As shown in the assembled version in FIG. 1, the three components, the sealing collet 26, the retaining collar 28 and the container flange 18, are held in a substantially fixed position by the frictional forces between the parts, enhanced by material on the outer surface 66 of the skirt 34 deforming around retaining rings 64, thereby inhibiting the removal of retaining collar 28 from the sealing collet 26. The flange 18 is secured between the deformed bottom portion 42 and the ring 30 to hold the assembly in a fixed position and to maintain the seal between the sealing collet 26 and the flange 18.

Figure 13:
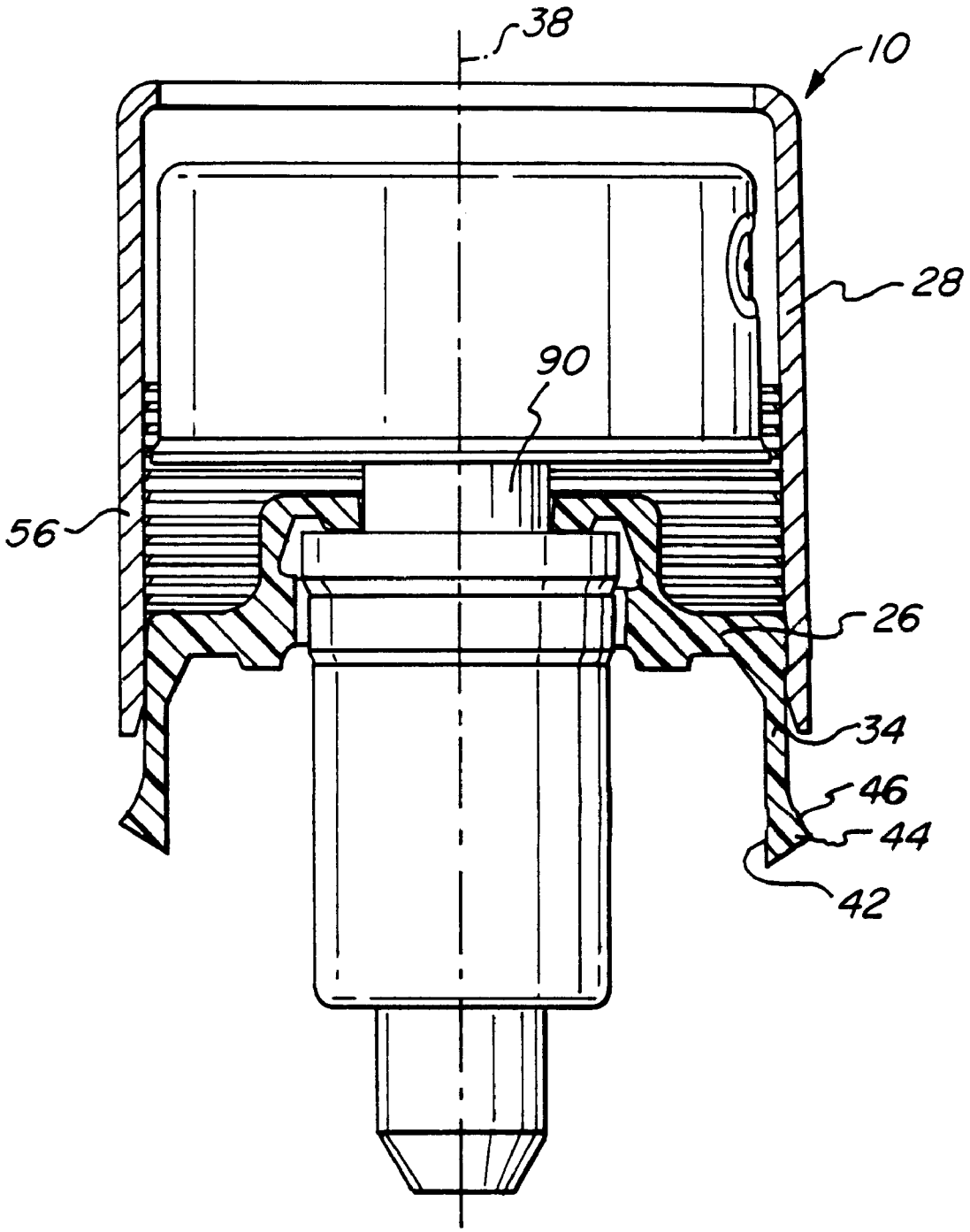
FIG. 13 is a partially cross-sectional view of an assembly for securing and sealing a dispenser to a flanged container in accordance with the present invention before being placed on a container.

As illustrated in FIG. 13, which shows assembly 10 before being placed on a container, the components of assembly 10 may be preassembled at the time of initial manufacture of assembly 10. More specifically, pump 90 may be affixed to sealing collet 26 as described above, and retaining collar 28 may be partially slid onto sealing collet 26. This allows the assembly 10 to be installed directly onto a container without the necessity assembling the parts during installation onto the bottle. This also allows for the inventorying of a single piece, instead of three or more separate pieces, which is often desirable.

The assembly 10 of the present invention may be employed to affix a spray pump assembly 90 securely and sealingly in place on the flange 18 of a container 12. The spray pump assembly 90 is shown for purposes of illustration only as being typical of those known in the art. The mode of operation of the assembly is similar to that shown in U.S. Pat. No. 5,192,006 to Van Brocklin et al., which is hereby incorporated by reference, and will not be explained in detail, since such will be immediately obvious to one skilled in the art. The pump is actuated by manual depression of actuator 92. In the embodiment shown, the actuator 92 is provided on its lower perimeter with a flange 94, the upper surface 96 of which engages the underside of a flange 98 disposed around the inner edge of the top 100 of retaining collar 28. This combination of elements forms a highly convenient method of maintaining the actuator 92 in place on the pump assembly 90 and avoids the possibility of accidental displacement of the actuator 92 during use, transportation and/or storage of the assembled product.

The present invention, therefore, provides an assembly which secures and seals a dispenser, such as a pump or valve, to a flanged container, which is less expensive than known assemblies to manufacture, which requires a reduced force to attach the assembly to the container, which provides an increased retention force of the components, which is aesthetically pleasing, and which can employ a standard collar used with known crimped assemblies.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An assembly for securing and sealing a dispenser to a flanged container, the assembly comprising:

a sealing collet comprising a resilient deformable molded polymeric material, said sealing collet having an outer surface having an outer diameter, and having a continuous downwardly extending skirt having a bottom portion thereof extending radially outwardly;

a retaining collar comprising a substantially rigid material, said retaining collar having a sleeve about its periphery, the sleeve having an inner surface having a diameter sized to encase the skirt of said sealing collet, said retaining collar slideable through a path of movement over said sealing collet to an assembled position, the sleeve of said retaining collar deforming the bottom portion of the skirt of said sealing collet radially inwardly to a position under the flange of the container as said retaining collar is slid to the assembled position, the sleeve of said retaining collar maintaining said retaining collar in the assembled position on said sealing collet; and, a plurality of annular retaining rings formed on the inner surface of the sleeve of said retaining collar, said plurality of annular retaining rings positioned to engage the outer surface of said sealing collet when said retaining collar is in the assembled position, and dimensioned such that said plurality of annular retaining rings cause the outer surface of said sealing collet to deform around said plurality of annular retaining rings when said retaining collar is in the assembled position to enhance the maintenance of said retaining collar in the assembled position on said sealing collet.

2. An assembly according to claim 1 wherein said plurality of annular retaining rings comprises a plurality of annular splines protruding from the inner surface of the sleeve of said retaining collar.

3. An assembly according to claim 2 wherein the plurality of annular splines have frustoconical portions having upper ends having a diameter less than the diameter of the inner surface of the sleeve of said retaining collar and having lower ends having a diameter greater than the diameter of the upper ends.

4. An assembly according to claim 3 wherein the lower ends of the frustoconical portions of the plurality of annular splines have a diameter substantially equal to the diameter of the inner surface of the sleeve of said retaining collar.

5. An assembly according to claim 2 wherein the plurality of annular splines comprises a plurality of barbed annular splines.

6. An assembly according to claim 2 wherein the plurality of annular splines comprises a plurality of partially rounded annular splines.

7. An assembly according to claim 1 wherein said plurality of annular retaining rings comprises a plurality of annular grooves recessed in the inner surface of the sleeve of said retaining collar.

8. An assembly according to claim 7 wherein the plurality of annular grooves have frustoconical portions having lower ends having a diameter greater than the diameter of the inner surface of the sleeve of said retaining collar and having upper ends having a diameter less than the diameter of the lower ends.

9. An assembly according to claim 8 wherein the upper ends of the frustoconical portions of the plurality of annular grooves have a diameter substantially equal to the diameter of the inner surface of the sleeve of said retaining collar.

10. An assembly according to claim 7 wherein the plurality of annular grooves comprises a plurality of partially rounded annular grooves.

11. An assembly according to claim 1 wherein said plurality of annular retaining rings comprises a plurality of annular grooves recessed in the inner surface of the sleeve of said retaining collar and a plurality of annular splines protruding from the inner surface of the sleeve of said retaining collar.

12. An assembly for securing and sealing a dispenser to a flanged container, the assembly comprising:

a sealing collet comprising a resilient deformable molded polymeric material, said sealing collet having an outer surface having an outer diameter, and having a continuous downwardly extending skirt having a bottom portion thereof extending radially outwardly;

a retaining collar comprising a substantially rigid material, said retaining collar having a sleeve about its periphery, the sleeve having an inner surface having a diameter sized to encase the skirt of said sealing collet, said retaining collar slideable through a path of movement over said sealing collet to an assembled position, the sleeve of said retaining collar deforming the bottom portion of the skirt of said sealing collet radially inwardly to a position under the flange of the container as said retaining collar is slid to the assembled position, the sleeve of said retaining collar maintaining said retaining collar in the assembled position on said sealing collet; and, a plurality of annular splines protruding inwardly from the inner surface of the sleeve of said retaining collar, said plurality of annular splines positioned to engage the outer surface of said sealing collet when said retaining collar is in the assembled position, and protruding to such an extent that said plurality of annular splines cause the outer surface of said sealing collet to deform around said plurality of annular splines when said retaining collar is in the assembled position to enhance the maintenance of said retaining collar in the assembled position on said sealing collet.

13. An assembly according to claim 12 wherein said plurality of annular splines have frustoconical portions having upper ends having a diameter less than the diameter of the inner surface of the sleeve of said retaining collar and having lower ends having a diameter greater than the diameter of the upper ends.

14. An assembly according to claim 13 wherein the lower ends of the frustoconical portions of the plurality of annular splines have a diameter substantially equal to the diameter of the inner surface of the sleeve of said retaining collar.

15. An assembly according to claim 12 wherein said plurality of annular splines comprises a plurality of barbed annular splines.

16. An assembly according to claim 12 wherein said plurality of annular splines comprises a plurality of partially rounded annular splines.

17. An assembly for securing and sealing a dispenser to a flanged container, the assembly comprising:

a sealing collet comprising a resilient deformable molded polymeric material, said sealing collet having an outer surface having an outer diameter, and having a continuous downwardly extending skirt having a bottom portion thereof extending radially outwardly;

a retaining collar comprising a substantially rigid material, said retaining collar having a sleeve about its periphery, the sleeve having an inner surface having a diameter sized to encase the skirt of said sealing collet, said retaining collar slideable through a path of movement over said sealing collet to an assembled position, the sleeve of said retaining collar deforming the bottom portion of the skirt of said sealing collet radially inwardly to a position under the flange of the container as said retaining collar is slid to the assembled position, the sleeve of said retaining collar maintaining said retaining collar in the assembled position on said sealing collet; and, a plurality of annular grooves recessed in the inner surface of the sleeve of said retaining collar, said plurality of annular grooves positioned to engage the outer surface of said sealing collet when said retaining collar is in the assembled position, and recessed to such an extent that said plurality of annular grooves cause the outer surface of said sealing collet to deform to substantially fill said plurality of annular grooves when said retaining collar is in the assembled position to enhance the maintenance of said retaining collar in the assembled position on said sealing collet.

18. An assembly according to claim 17 wherein said plurality of annular grooves have frustoconical portions having lower ends having a diameter greater than the diameter of the inner surface of the sleeve of said retaining collar and having upper ends having a diameter less than the diameter of the lower ends.

19. An assembly according to claim 18 wherein the upper ends of the frustoconical portions of said plurality of annular grooves have a diameter substantially equal to the diameter of the inner surface of the sleeve of said retaining collar.

20. An assembly according to claim 17 wherein said plurality of annular grooves comprises a plurality of partially rounded annular grooves.

21. An assembly for securing and sealing a dispenser to a flanged container, the assembly comprising:

a sealing collet comprising a resilient deformable molded polymeric material, said sealing collet having an outer surface having an outer diameter, and having a continuous downwardly extending skirt having at a bottom thereof a camming surface protruding radially outwardly;

a retaining collar comprising a substantially rigid material, said retaining collar having a sleeve about its periphery, the sleeve having an inner surface having a diameter sized to encase the skirt of said sealing collet, said retaining collar slideable through a path of movement over said sealing collet to an assembled position, the sleeve of said retaining collar deforming the camming surface of the skirt of said sealing collet radially inwardly as said retaining collar is slid to the assembled position, the sleeve of said retaining collar maintaining said retaining collar in the assembled position on said sealing collet; and, a plurality of annular retaining rings formed on the inner surface of the sleeve of said retaining collar, said plurality of annular retaining rings positioned to engage the outer surface of said sealing collet when said retaining collar is in the assembled position, and dimensioned such that said plurality of annular retaining rings cause the outer surface of said sealing collet to deform around said plurality of annular retaining rings when said retaining collar is in the assembled position to enhance the maintenance of said retaining collar in the assembled position on said sealing collet.

22. An assembly according to claim 21 wherein said plurality of annular retaining rings comprises a plurality of annular splines protruding from the inner surface of the sleeve of said retaining collar.

23. An assembly according to claim 22 wherein the plurality of annular splines have frustoconical portions having upper ends having a diameter less than the diameter of the inner surface of the sleeve of said retaining collar and having lower ends having a diameter greater than the diameter of the upper ends.

24. An assembly according to claim 23 wherein the lower ends of the frustoconical portions of the plurality of annular splines have a diameter substantially equal to the diameter of the inner surface of the sleeve of said retaining collar.

25. An assembly according to claim 22 wherein the plurality of annular splines comprises a plurality of barbed annular splines.

26. An assembly according to claim 22 wherein the plurality of annular splines comprises a plurality of partially rounded annular splines.

27. An assembly according to claim 21 wherein said plurality of annular retaining rings comprises a plurality of annular grooves recessed in the inner surface of the sleeve of said retaining collar.

28. An assembly according to claim 27 wherein the plurality of annular grooves have frustoconical portions having lower ends having a diameter greater than the diameter of the inner surface of the sleeve of said retaining collar and having upper ends having a diameter less than the diameter of the lower ends.

29. An assembly according to claim 28 wherein the upper ends of the frustoconical portions of the plurality of annular grooves have a diameter substantially equal to the diameter of the inner surface of the sleeve of said retaining collar.

30. An assembly according to claim 27 wherein the plurality of annular grooves comprises a plurality of partially rounded annular grooves.

31. An assembly according to claim 21 wherein said plurality of annular retaining rings comprises a plurality of annular grooves recessed in the inner surface of the sleeve of said retaining collar and a plurality of annular splines protruding from the inner surface of the sleeve of said retaining collar.

* * * * *